United States Patent [19]

Davis

[11] 4,132,407

[45] Jan. 2, 1979

[54] BOWLING TRAINING DEVICE

[76] Inventor: Leo C. Davis, 3700 Madison, Denver, Colo. 80205

[21] Appl. No.: 751,253

[22] Filed: Dec. 17, 1976

[51] Int. Cl.[2] ..... A63B 69/00

[52] U.S. Cl. ..... 273/54 B; 273/189 A

[58] Field of Search ..... 273/54 B, 189 A

[56] References Cited

U.S. PATENT DOCUMENTS 1,457,710 6/1923 MacDonald ..... 273/189 A X 3,698,389 10/1972 Guedel ..... 273/189 A X 3,970,305 7/1976 Hawkins ..... 273/54 B

*Primary Examiner*—Anton O. Oechsle

*Attorney, Agent, or Firm*—Richard D. Law

[57] ABSTRACT

A hinged frame, having attachment straps for mounting the frame on the inside of a user's elbow, and a drop lock which permits an initial bending of a user's arm then locks the arm straight on the user straightening his arm for bowling ball delivery.

1 Claim, 4 Drawing Figures

BOWLING TRAINING DEVICE

This invention relates to training devices for teaching a bowler to swing, then release a ball and follow through all with proper ball delivery. The device permits the user's arm to be initially bent for holding the ball until the first swing of the bowler's arm.

In bowling a number of body and arm movements are common to all types of ball deliveries. Prior to the approach steps, the ball is held with two hands in front of the bowler with bent arms. The approach steps are commenced and the ball is swung like a pendulum leading to the delivery of the ball to the alley and then releasing the same. The swing, the release and the follow-through after the release is most effectively accomplished for consistent bowling using a straight arm. Bowling instructors stress the pendulum swing of the ball and the follow-through with a straight arm. This concept is rather difficult for a novice bowler, as well as occasional bowlers, to consistently repeat time after time, particularly since so many other movements, positions, etc. must be remembered. Even professional bowlers at times may require some instruction or at least a review of their delivery and a strengthening of their particular talents in the game.

According to the present invention a hinged frame is arranged to be fastened on a bowler's arm at the inside of the elbow so that a portion of the frame is mounted on the bicep and a portion on the forearm. The hinged frame permits the user to move and bend the arm in a normal manner. The frame portions are rigid so that a rod loosely held in a loop on the upper part of the frame is free to move onto the lower portion of the frame by dropping when the frame is straightened, thereby preventing bending of the frame and the arm to which it is attached.

Included among the objects and advantages of the present invention is to provide a training device for bowlers.

Another object of the invention is to provide a device for automatically holding a bowler's arms straight for the delivery, release and follow-through of a bowling ball.

Yet another object of the invention is to provide a bowling training device which permits the user's arm to be bent when needed and to be held in a straight position for swinging and release and follow-through of the bowling ball.

Still another object of the invention is to provide a means for automatically holding a bowler's arm straight and a locking means which may be removed until it is needed permitting the bowler free use of the arm until the lock means is replaced.

These and other objects and advantages of the invention may be readily ascertained by referring to the following description and appended illustrations in which.

Figure 1:
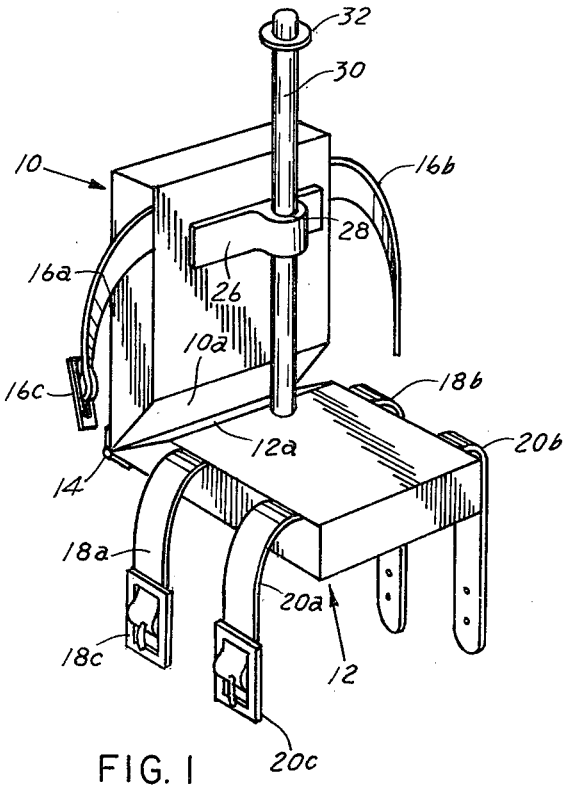
FIG. 1 is a perspective view of one form of the invention arranged for attachment to a bowler's arm in a bent position.
Figure 2:
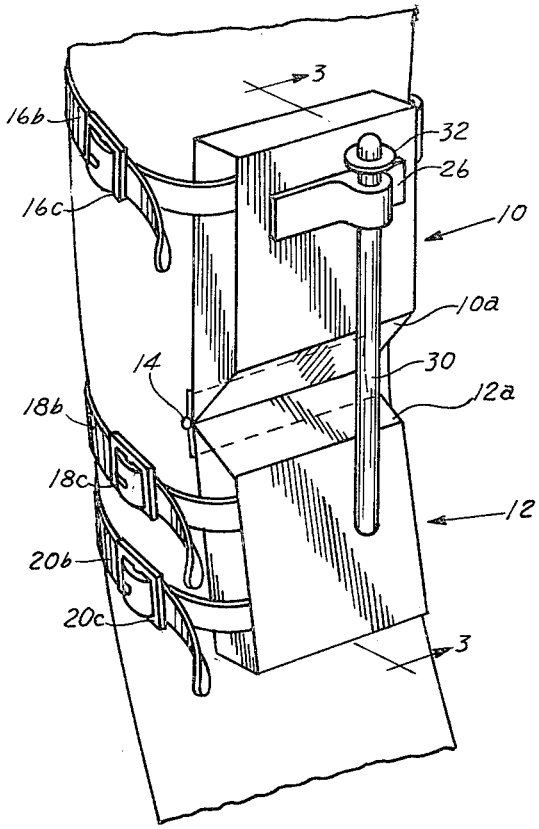
FIG. 2 is a perspective view of the embodiment of FIG. 1 attached to a bowler's arm, illustrating the locked position.
Figure 3:
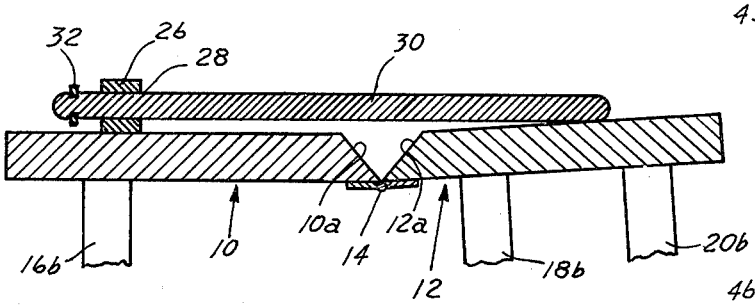
FIG. 3 is a side elevational view of the device of FIG. 2 taken along section lines 3—3.

In the device illustrated in FIGS. 1-3, the training means includes an upper frame section, shown in general by numeral 10, and a lower frame section, shown in general by numeral 12. The frame sections are rectangular pieces of material, formed of wood, plastic, leather or the like, and are joined together by means of a hinge 14, such as a piano hinge, etc. The joining ends of each of the sections of the frame are beveled; thus, frame 10 has a beveled edge **10*a* and frame section 12 has its beveled edge 12*a*. The bevels are normally at about 45° to permit the two frame sections to move into a straight alignment. The upper frame member 10 is attached to the lower biceps of a person's arm by means of a strap which provides adjustment for different sizes, and may be formed of a single strap passed through an opening in the frame or of several portions of a strap. When portions of the strap are used, a strap 16*a* portion having a buckle 16*c* is arranged to be attached to one side, while the opposite side 16*b* of the strap is attached to the other side of the frame. The strap may be fastened to the frame in any manner desired, such as nails, adhesive or the like. In a similar manner, the lower frame 12 is attached to an arm by means of straps 18*a* and 18*b* held together by means of buckle 18*c*, and, also, strap 20*a* and 20*b* held together by means of buckle 20*c*. The straps 18 and 20** are attached to the forearm of the person with the hinge at about the elbow. With the two frames strapped to the arm of the user the user may of course freely bend his arm since the frame hinges at about the elbow.

A locking device is provided for holding the frame in a straight position, and this includes a holder 26 attached to the upper frame 10. The holder includes a bore 28 in a boss on the holder 26. A rod 30 is arranged to freely pass through the bore 28 and it is provided with a stop 32 at one end while the opposite end is of the same diameter as the rod. The construction is arranged so that the rod may be freely withdrawn from the holder. Except when the bowler is actually in position to bowl, the rod 30 may be withdrawn from the holder giving the user free use of his arm. When the bowler's turn approaches, the bowler takes the rod 30 and inserts it in the opening 28 so that a lock may be provided. The bowler takes the bowling ball and holds it in front of himself while lining up on the approach to the alley. The arms are bent holding the ball in front of the bowler, and the rod 30 is in upper position permitting the frame to bend as shown in FIG. 1. As the bowler approaches the alley, the ball is permitted to swing in pendulum fashion with the arm straight. As the arm straightens the rod 30 passes downwardly through the bore 28 to the stop 32 with the lower end of the rod against the frame 12 to maintain the arm in straight position. Thus, the bowler's arm is in straight position for the swing of the ball, the release of the ball, and for the follow-through where the person's arm is moved upwardly away from the released ball. When the bowler leaves the delivery line of the alley, the rod 30 may be withdrawn and the bowler's arm may be freely used as without the device.

Figure 4:
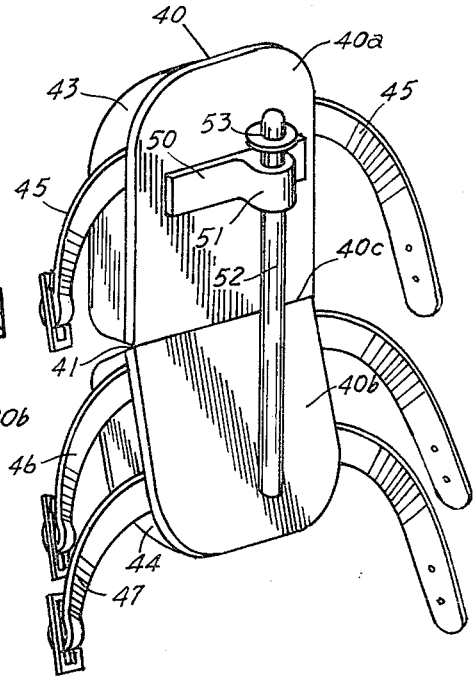
FIG. 4 is a perspective view of a modified form of the invention illustrating the locked position of a training device according to the invention.

The modification shown in FIG. 4 includes a planar piece of synthetic resin 40 such as polyethylene, preferably polypropylene, and similar types of plastic which are semi-rigid and in thick section are essentially rigid. The frame 40 includes an upper frame portion **40*a* and a lower frame portion 40 *b* connected by means of a thinner section of the plastic 40*c*. The thinner section is formed by cutting out a slot portion 41 in the planar pieces of plastic 40 behind the crease line 40c. The crease line therefore acts as a hinge permitting the two planar sections 40a and 40b to move angularly with respect to one another. A soft, resilient pad 43 is attached to the planar section 40a and a similar pad 44 is attached to the back of the planar piece 40b. The pads may be soft, resilient material and preferably are foamed plastic or foam rubber secured by adhesive to the planar members providing a soft pad for the user's arm. In this device, the attachment is in a similar manner by means of a strap 45 secured to the back of a planar member 40a and straps 46 and 47 secured to the planar member 44**. These straps may be leather or plastic or any suitable material and may be fastened by means of buckles, Velcro fastening, or the like.

The device is used in similar manner to that of the device of FIGS. 1, 2 and 4, wherein the upper planar member has a lock member 50 having an apertured boss 51. A rod 52 passes through the aperture and a stop 53 prevents the complete passage of the rod through the aperture opening. The rod is freely reciprocal in the lock member so that it readily falls to the locked position as the user's arm is straightened, and also to permit the rod to be freely removed from the lock portion when not needed.

What is claimed is:

1. A training device for attachment to the elbow region of a bowler's arm, comprising:

an upper frame having a front surface;

a lower frame having a generally planar front surface area centrally thereof;

hinge means connecting said upper frame and said lower frame for pivotal movement about a transverse hinge axis;

strap means carried by said upper frame, for attaching said upper frame to the lower biceps of the arm of the bowler, just above the elbow;

strap means carried by said lower frame, for attaching said lower frame to the forearm of said bowler just below the elbow, said hinged upper and lower frames being constructed and arranged to be attached on the inside of the bowler's arm with said transverse hinge axis lying parallel to the elbow so that said frames are pivotable relative to each other between angular and aligned positions when the elbow is moved between bent and straight arm positions, respectively;

bracket means mounted on said front surface of said upper frame in alignment with said generally planar front surface area of said lower frame, and having an elongated bore extending therethrough of substantially uniform diameter and disposed at generally a right angle to said transverse hinge axis; and an elongated, rigid pin of substantial weight and having an upper and a lower end, said upper end carrying an enlarged head substantially larger in diameter than said elongated bore, the portion of said pin between said enlarged head and the lower end of said pin being substantially straight and having a substantially uniform diameter that is substantially less than the diameter of said elongated bore, whereby said pin is freely movable by the force of gravity alone through said cylindrical bore;

said rigid pin having a length between said enlarged head and said lower end thereof that is at least as great as the distance measured from the upper end of said elongated bore to the mid portion of said generally planar front surface area of said lower frame, when said upper and lower frame are in an aligned position, and said elongated bore being positioned so that when said upper and said lower frames are in aligned position and said rigid pin is received in said elongated bore, the lower portion of said pin will be in closely spaced relationship to said generally planar front surface area, whereby the bowler, when wearing said training device, can freely insert said rigid pin into the upper end of said elongated bore, the lower end of said pin resting on said lower frame when the elbow is bent, and said rigid pin falling by gravity through said elongated bore when the elbow is straightened so as to lie in close relationship to said generally planar front surface area, whereby said rigid pin and said hingedly connected upper and lower frames thereafter cooperate to restrain further bending of said elbow.

* * * * *